US012359823B2

(12) United States Patent
Schorr

(10) Patent No.: US 12,359,823 B2
(45) Date of Patent: Jul. 15, 2025

(54) SYSTEM HAVING A COOKING DEVICE WITH A COOKING CHAMBER CONNECTED TO AN ELECTRICAL GRID AND AN ENERGY STORAGE DEVICE

(71) Applicant: RATIONAL Wittenheim SAS, Wittenheim (FR)

(72) Inventor: Fabrice Schorr, Wittenheim (FR)

(73) Assignee: RATIONAL WITTENHEIM SAS, Wittenheim (FR)

( * ) Notice: Subject to any disclaimer, the term of this patent is extended or adjusted under 35 U.S.C. 154(b) by 41 days.

(21) Appl. No.: 17/909,715

(22) PCT Filed: Mar. 31, 2021

(86) PCT No.: PCT/EP2021/058491
§ 371 (c)(1),
(2) Date: Sep. 6, 2022

(87) PCT Pub. No.: WO2021/198363
PCT Pub. Date: Oct. 7, 2021

(65) Prior Publication Data

US 2024/0210041 A1 Jun. 27, 2024

(30) Foreign Application Priority Data

Apr. 1, 2020 (DE) ..... 10 2020 109 015.3

(51) Int. Cl.
*F24C 9/00* (2006.01)
*F24C 7/08* (2006.01)

(52) U.S. Cl.
CPC . *F24C 7/08* (2013.01); *F24C 9/00* (2013.01)

(58) Field of Classification Search
CPC ..... F24C 9/00
See application file for complete search history.

(56) References Cited

U.S. PATENT DOCUMENTS 6,267,045 B1 7/2001 Wiedemann et al. .... A23L 1/00
6,380,715 B1 4/2002 Kubo ..... H01M 10/46
(Continued)

FOREIGN PATENT DOCUMENTS

BE 1022208 B1 4/2014
CN 102183048 A 9/2011
(Continued)

OTHER PUBLICATIONS

PCT International Search Report and Written Opinion issued in PCT International Patent Application Serial No. PCT/EP2021/058491, dated Jun. 21, 2021, 18 pages.
(Continued)

*Primary Examiner* — Suresh Suryawanshi
(74) *Attorney, Agent, or Firm* — HAYES SOLOWAY P.C.

(57) ABSTRACT

A system including at least one cooking device having a connection for connecting the cooking device to a electrical grid and a connection for connecting the cooking device to an energy storage device, has a control unit which is set up to regulate a power draw from the electrical grid and/or from the energy storage device during operation of the at least one cooking device based on a heating requirement of the cooking device such that the power draw from the electrical grid does not exceed a defined threshold value ($L_{Max}$).

13 Claims, 3 Drawing Sheets

(56) References Cited

U.S. PATENT DOCUMENTS

| | | | | |
|---|---|---|---|---|
| 2012/0242159 | A1* | 9/2012 | Lou | H03H 7/40 307/104 |
| 2012/0323396 | A1* | 12/2012 | Shelton | H02M 7/44 700/297 |
| 2020/0068673 | A1* | 2/2020 | Galindo Perez | H05B 11/00 |

FOREIGN PATENT DOCUMENTS

| | | | | |
|---|---|---|---|---|
| CN | 109276149 | | 1/2019 | A47J 37/06 |
| DE | 20121925 | | 5/2001 | F24C 7/08 |
| DE | 10022731 | A1 * | 11/2001 | A47J 27/62 |
| DE | 10126199 | A1 * | 12/2002 | F24C 7/08 |
| DE | 202005017942 | | 11/2005 | F24C 7/02 |
| DE | 102014018049 | | 6/2016 | H02J 9/06 |
| EP | 2211117 | | 7/2010 | F24C 7/08 |
| GB | 2572490 | A * | 10/2019 | A47J 36/321 |
| JP | 5-226071 | | 9/1993 | H05B 6/66 |
| JP | 2009021027 | A * | 1/2009 | |
| WO | WO9963277 | | 12/1999 | F24C 15/34 |
| WO | WO2011106355 | | 9/2011 | G06F 9/44 |
| WO | WO-2015159923 | A1 * | 10/2015 | F24C 7/08 |
| WO | WO2016134014 | | 8/2016 | H02M 5/00 |
| WO | WO2018116056 | | 6/2018 | H05B 6/12 |

OTHER PUBLICATIONS

PCT International Preliminary Report on Patentability issued in PCT International Patent Application Serial No. PCT/EP2021/058491, dated Sep. 29, 2022, 7 pages.

* cited by examiner

SYSTEM HAVING A COOKING DEVICE WITH A COOKING CHAMBER CONNECTED TO AN ELECTRICAL GRID AND AN ENERGY STORAGE DEVICE

CROSS REFERENCE TO RELATED APPLICATION

This application is a 371 National Phase application of PCT/EP2021/058491, filed 2021 Mar. 31, claiming priority to German Application 102020109015.3, filed 2020 Apr. 1.

BACKGROUND OF THE INVENTION

The invention relates to a system having at least one cooking device.

For commercial customers of power utilities, electricity is usually consumed in such quantities that a method of recording power measurement (German RLM, Registrierende Leistungsmessung) is used for the billing of the utility. This is standard for companies with more than 100 MWh. The amount of energy consumed (in kWh) per 15 min. time interval is measured and divided, and the resulting kW value is taken as the basis for the demand charge (the total electricity price is composed of the consumption charge and the demand charge). The peak value determined is used as the basis for the entire month. If a high kW value is required only once, the total costs will increase on the whole. To prevent this, controls are known in which processes are started with a delay or run at a lower intensity such that a defined peak value is not exceeded.

The drawback is that the limitation may have a negative effect on the processes for which the equipment is used or that processes are completed with a delay. For example, if cooking devices are involved, it must be prevented that the control by means of which the power consumption is reduced, has a negative effect on the cooking result. In addition, certain cooking processes should not be delayed for an excessively long time.

It is therefore an object of the present invention to provide a system having at least one cooking device in which a power draw from a electrical grid is limited without the limitation having a negative effect on the cooking process. The "power draw" is here the power that the cooking device draws from the electrical grid. Thus, viewed from the side of the electrical grid, it is the power output to the cooking device.

SUMMARY OF THE INVENTION

According to the invention, this object is achieved by a system comprising at least one cooking device having a connection for connecting the cooking device to a electrical grid and a connection for connecting the cooking device to an energy storage device, and comprising a control unit which is set up to regulate a power draw from the electrical grid and/or from the energy storage device during operation of the at least one cooking device based on a heating requirement of the cooking device such that the power draw from the electrical grid does not exceed a defined threshold value.

As the cooking device can also be operated by means of the energy storage device as an alternative to or in addition to the electrical grid, the advantage is achieved that a total power requirement of the cooking device can selectively be covered by the electrical grid or the energy storage device, at least as long as the total power requirement does not exceed a total connected load of the cooking device. In particular, the cooking device can be supplied simultaneously with power from the electrical grid and with power from the energy storage device if the power consumption of the cooking device is above a defined threshold value in a certain time interval.

Thus, a power draw from the electrical grid can be limited without the limitation of the power draw from the electrical grid negatively affecting the cooking processes. That is, no cooking processes need to be delayed or run at reduced power. In particular, the heating requirement of the at least one cooking device can be fully covered, and a cooking process can run optimally. By limiting the power draw, energy costs can also be limited so that the cooking device can be operated in a particularly cost-efficient manner.

A further advantage is that particularly powerful cooking devices can be operated with an existing infrastructure without having to make an additional investment in the infrastructure. This is because the connection lines laid in an existing system are usually designed for a defined, maximum connected load which must not be exceeded.

For example, the defined threshold value which is not to be exceeded is a maximum of 25 kW, in particular 20 kW.

In addition, the system according to the invention enables energy cost management in that the energy storage device can be charged when comparatively inexpensive electricity is available, and the energy from the energy storage device can be used when there are shortages or when energy is comparatively expensive.

In particular, the connection for connecting the cooking device to the electrical grid is formed separately from the connection for connecting the cooking device to the energy storage device.

The heating requirement is determined, for example, based on a difference between a set temperature and an actual temperature.

The energy storage device is, for example, an electrochemical energy storage device, in particular an accumulator, an electrical energy storage device, in particular a capacitor or a supercapacitor, a combination of an accumulator and a capacitor, or a flywheel.

The control unit is preferably set up to regulate the power draw from the electrical grid and/or from the energy storage device based on a current heating requirement and/or based on an expected heating requirement. For example, the control unit is set up to delay a power draw from the energy storage device if it is foreseeable that the energy from the energy storage device will be needed at a later time and the energy storage device cannot be charged in the meantime. Furthermore, the control unit can be set up to regulate a power draw from the electrical grid such that the power draw is distributed over a longer period of time. This means that a power draw from the electrical grid can be brought forward to be able to cover an expected heating requirement without the power draw from the electrical grid exceeding the defined threshold value.

According to one embodiment, the control unit is set up to operate the cooking device such that a power draw takes place simultaneously from the electrical grid and the energy storage device to cover demand peaks during a cooking process. The cooking processes carried out with the cooking device can thus be carried out according to an optimum power profile, as a result of which an optimum cooking result can be achieved. For example, power can be drawn from the energy storage device if a temperature in a cooking chamber of the cooking device is to be increased particularly sharply for a short time. In particular, a demand peak occurs when a total power demand of the cooking device exceeds the defined threshold value or when the power consumption of the cooking device is above a defined threshold value.

For example, the control unit can be set up to operate the cooking device such that during a preheating phase, a power draw takes place simultaneously from the electrical grid and the energy storage device. In this way, the preheating phase can be shortened compared to operation without energy storage device without a power draw from the electrical grid exceeding the defined threshold value, By shortening the preheating phase, a cooking process can be shortened overall.

The control unit can also be set up to regulate a power draw from the energy storage device such that the power draw from the energy storage device takes place over a period of no more than 15 minutes at a time. In this way, a capacity of the energy storage device can be limited so that the energy storage device can be designed to be particularly compact. The energy storage device has a capacity of 1.5 kWh to 20 kWh, for example. By drawing power for a maximum of 15 minutes at a time, it is further avoided that the energy storage device discharges too quickly.

According to one embodiment, the system includes a kitchen management means which controls the course of various cooking processes, the control unit being connected to the kitchen management means such that the control unit can receive information from the kitchen management means about current and/or planned cooking processes, in particular information about a heating requirement of the cooking processes. From this information, the control unit can determine a current and planned total heating requirement and regulate a power draw from the electrical grid and/or the energy storage device accordingly.

The control unit can also be set up to operate the cooking device such that, in the event of a failure of the electricity supply by the electrical grid, the cooking device can be operated by the energy storage device alone. It is thus ensured that cooking processes can be continued or completed even in the event of a failure of the power supply by the electrical grid.

The control unit is preferably set up to control a charging process for charging the energy storage device. It is for example possible to control when the energy storage device is charged. For example, the control unit is set up to control the charging process of the energy storage device depending on an expected heating requirement. In particular, the control unit is set up to control the charging process of the energy storage device such that the energy storage device is charged when the expected heating requirement is low and a power draw from the energy storage device is not required at least until the energy storage device is charged at least to a predefined state of charge.

The control unit is set up, for example, to charge the energy storage device by means of renewable energies, in particular by means of photovoltaics or wind energy. For this purpose, the system is connected to a photovoltaic system or a wind energy system, for example. This allows the cooking device to be operated in a particularly climate-friendly manner. In addition, charging the energy storage device by means of renewable energies may be particularly cost-effective.

Alternatively or additionally, the control unit may be set up to charge the energy storage device using night current. Night current is generally cheaper than day current, so that the cooking device can be operated particularly cost-effectively by charging the energy storage device using night current.

The control unit may be set up to operate the cooking device at least temporarily such that a power draw takes place exclusively from the energy storage device when the latter has been charged using renewable energies. This enables particularly cost-effective and climate-friendly operation of the cooking device.

Therefore, the energy cost management can take place by means of the control unit.

Preferably, the system includes at least one energy storage device to which the cooking device is connected so that the cooking device can be supplied with energy from the energy storage device.

For example, the at least one energy storage device is arranged separately from the cooking device.

According to one embodiment, the system includes at least two cooking devices connected to the same energy storage device. In this way, costs can be saved in systems having several cooking devices, as it is not necessary to provide a separate energy storage device for each cooking device.

BRIEF DESCRIPTION OF THE DRAWINGS

Further advantages and features of the invention will become apparent from the description below and from the accompanying drawings, to which reference is made and in which.

DETAILED DESCRIPTION OF THE INVENTION

Figure 1:
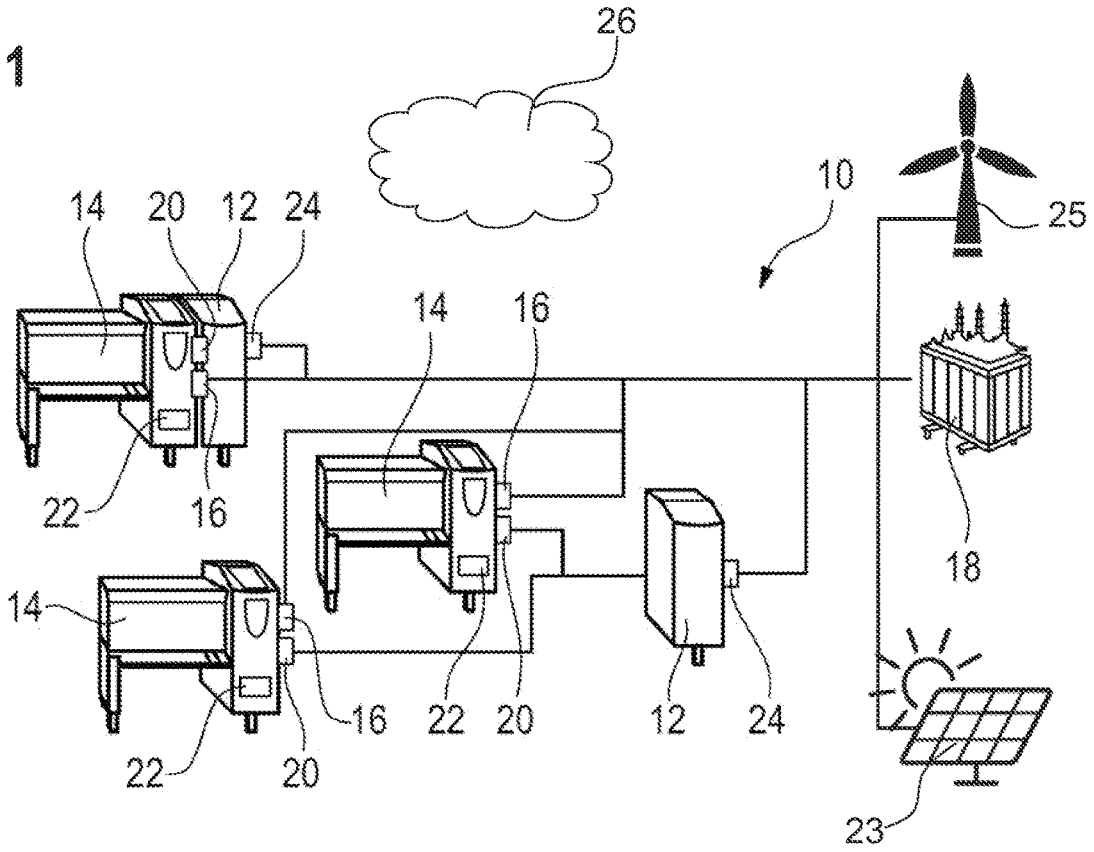
FIG. 1 shows a system according to the invention with several cooking devices.

FIG. 1 shows a system 10 comprising two energy storage devices 12 and a plurality of cooking devices 14, each having a connection 16 for connecting the cooking device 14 to an electrical grid 18 and a connection 20 formed separately from the connection 16 for connecting the cooking device 14 to the energy storage device 12. In addition, the cooking devices 14 each have a control unit 22. In the illustrated example embodiment, the control units 22 are each integrated into the cooking devices 14. However, it is also possible that the control units 22 are integrated in the energy storage devices 12.

The cooking devices 14 are each connected to the electrical grid 18 and to an energy storage device 12, so that a power demand of the cooking devices 14 can be served by both the energy storage device 12 and the electrical grid 18.

In particular, the cooking devices 14 are multifunctional cooking devices such as a combi steamer.

The energy storage devices 12 also have a connection 24 to the electrical grid 18 to allow charging of the energy storage devices 12.

Alternatively or additionally, the energy storage devices 12 may be connected to a photovoltaic system 23 or to a wind energy system 25.

Provided that no energy is required to charge the energy storage devices 12, the energy generated from the photovoltaic system 23 or the wind energy system 25 can be fed into the electrical grid 18.

The energy storage devices 12 are each formed separately from the cooking devices 14. One of the energy storage devices 12 is arranged directly adjacent to a cooking device 14 and connected thereto, while the other energy storage device 12 is free-standing, i.e., spaced apart from the cooking devices 14. Two cooking devices 14 are connected to the free-standing energy storage device 12. It is also conceivable to integrate the energy storage device 12 into a cooking device 14, but this would make it more difficult to replace the energy storage devices 12. In addition, this would greatly increase the weight of the cooking device 14, making a transport difficult.

The control of the electricity supply or the power draw from the electrical grid 18 and from the energy storage device 12 is performed for each cooking device 14 by means of the control unit 22, which is set up to regulate a power draw from the electrical grid 18 and/or from an energy storage device 12 during operation of the cooking devices 14, more specifically based on a heating requirement of the cooking devices 14. In other words, the control unit 22 regulates the electricity supply of the respective cooking device 14.

More specifically, each control unit 22 is set up to regulate a power draw from the electrical grid 18 and/or from the energy storage device 12 based on a current heating requirement and/or based on an expected heating requirement.

The power draw from the electrical grid 18 is not to exceed a defined threshold value $L_{Max}$.

For this purpose, the control unit 22 is set up to regulate the power draw from the electrical grid 18 such that the threshold value $L_{Max}$ is not exceeded. In addition, the control unit 22 regulates the power draw from the energy storage device 12 such that the total power demand of the cooking device 14 is covered.

Scenarios may also occur, for example during preheating or heating, in which the total power demand of the cooking device 14 is greater than a total connected load of the cooking device 14. In this case, the control unit 22 regulates the power draw from the energy storage device 12 such that the difference between the total connected load and the maximum connected load to the electrical grid is compensated by the energy storage device 12.

The control units 22 may be configured to communicate with each other. One of the control units 22 may act as a master for the remaining control units 22.

When the system 10 includes a plurality of cooking devices 14 as in the illustrated example embodiment, a total power draw from the electrical grid 18 to operate all of the cooking devices 14 should not exceed the defined threshold value $L_{Max}$.

FIGS. 2 to 4 and FIG. 6 illustrate the power draw of a cooking device 14 during a cooking process or during several cooking processes for various scenarios, the power draw being plotted in a diagram against the duration of the cooking process. FIG. 5 illustrates a cooking process using a temperature profile.

Figure 2:
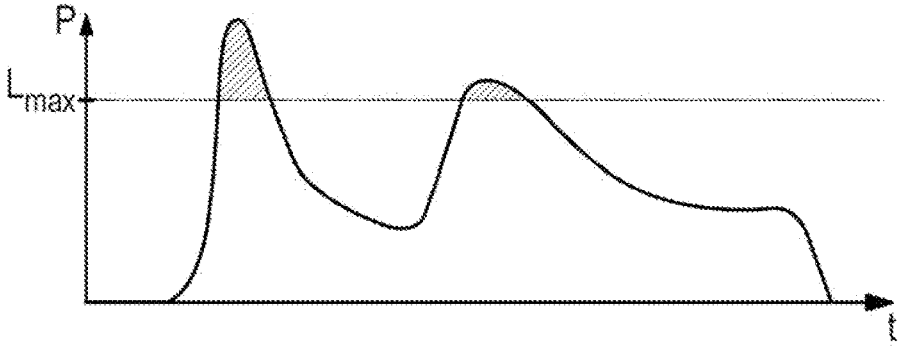
FIG. 2 shows a diagram illustrating a heating requirement of a cooking device during a first cooking process.

In the scenario illustrated in FIG. 2, two demand peaks occur during the cooking process, during which the power draw of the cooking device is particularly high and the power exceeds the defined threshold value $L_{Max}$. The first demand peak occurs during a preheating phase and the second demand peak during a cooking phase in which the cooking chamber is loaded with food to be cooked.

To cover the power demand during the demand peaks, the control unit 22 regulates an electricity supply of the cooking device 14 during the duration of the exceeding of the defined threshold value $L_{Max}$ such that the power demand is met both from the electrical grid 18 and from the energy storage device 12. In other words, for the duration that the defined threshold value $L_{Max}$ is exceeded, power is drawn simultaneously from the electrical grid 18 and from the energy storage device.

However, the power draw from the energy storage device preferably takes place over a period of no more than 15 minutes at a time.

Figure 3:
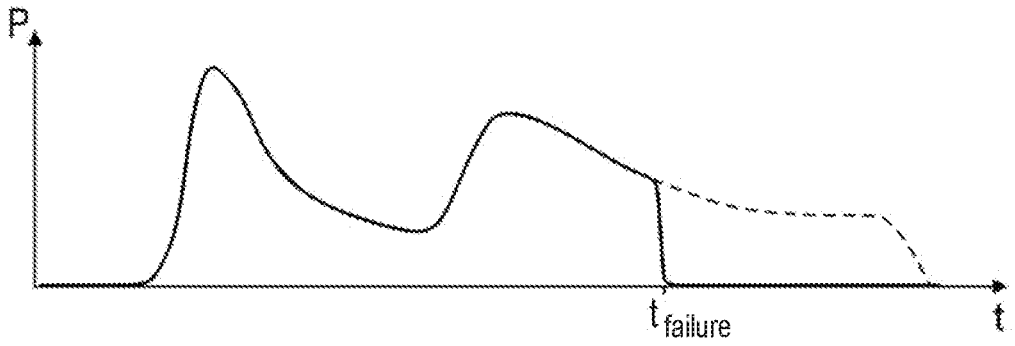
FIG. 3 shows a diagram illustrating a cooking process during which a malfunction occurs.

FIG. 3 illustrates a scenario in which a power failure occurs during a cooking process.

In this scenario, a power demand is initially covered exclusively by a power draw from the electrical grid 18, which is illustrated in FIG. 3 by a continuous curve.

From a time $t_{failure}$ onward, when a power failure occurs, the control unit 22 regulates a power draw from the electrical grid 18 and the energy storage device 12 such that the power demand of the cooking device 14 is covered exclusively by a power draw from the energy storage device 12, which is illustrated in FIG. 3 by a dashed curve. In this way, a cooking process can be completed as planned, and it is prevented that the food cooked in the cooking chamber becomes unusable or that a cooking result is not optimal. Such a control of the power draw is particularly advantageous in those regions where electricity supply disturbances occur frequently.

If, in the scenario shown in FIG. 3, demand peaks occur before the time $t_{failure}$, these can also be covered by drawing power from the energy storage device 12.

Figure 4:
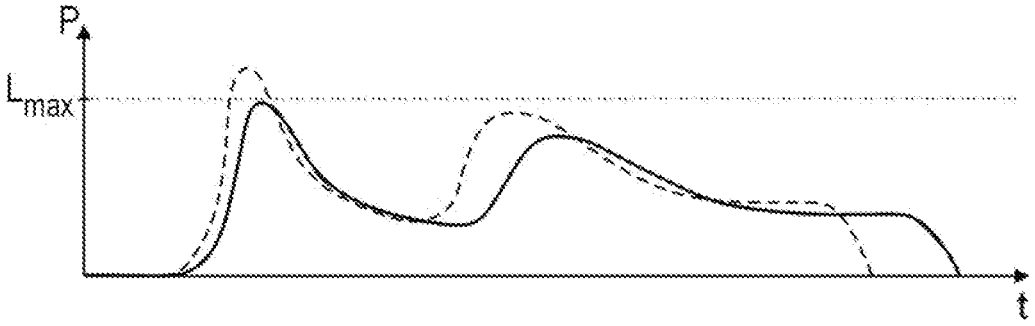
FIG. 4 shows a diagram illustrating a further cooking process.
Figure 5:
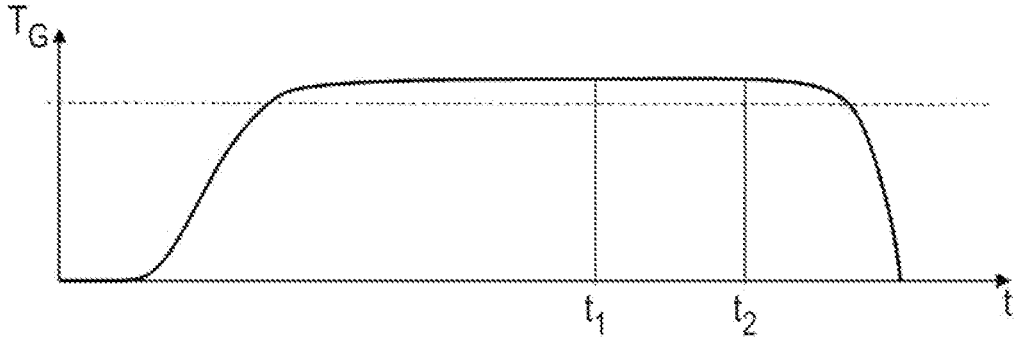
FIG. 5 shows a diagram illustrating yet a further cooking process.

FIG. 4 illustrates a scenario in which a power demand of the cooking device can basically be covered from the electrical grid 18 without exceeding a defined threshold value $L_{Max}$. This is illustrated in FIG. 4 by means of a first, continuous power curve.

However, the control unit 22 is set up to operate the cooking device 14 such that power is additionally drawn from the energy storage device 12 during a preheating phase. In this way, the preheating phase can be shortened, which shortens the overall cooking process. During a preheating phase, for example, a cooking chamber of the cooking device 14 can be brought to a defined temperature or water can be brought to a boil. For comparison, a power curve of such a shortened cooking process is shown in a dashed line in FIG. 4.

FIG. 5 illustrates a scenario in which a cooking process takes place over a longer period of time, for example over eight hours. In particular, the cooking process takes place overnight. In the diagram illustrated in FIG. 5, a cooking chamber temperature $T_G$ is plotted against time.

After a heating phase, the cooking chamber temperature $T_G$ is kept as constant as possible, e.g. at at least 63° C. This ensures a reliable, continuous cooking process. In particular, it is to be prevented that food to be cooked cools to a temperature below 63° during the cooking process before the food to be cooked is fully cooked. It is thus ensured that the quality of the food to be cooked is not degraded.

In the scenario illustrated in FIG. 5, a failure of the electricity supply by the electrical grid 18 occurs during the cooking process between a time $t_1$ and a time $t_2$. During this period, the control unit 22 controls a power supply of the cooking device 14 such that the cooking device 14 is operated solely by means of the energy storage device 12.

As soon as the electricity supply by the electrical grid 18 is possible again, in particular from time $t_2$, the cooking device 14 is operated again by means of electricity from the electrical grid 18. The energy storage device 12 can be recharged from time $t_2$.

Figure 6:
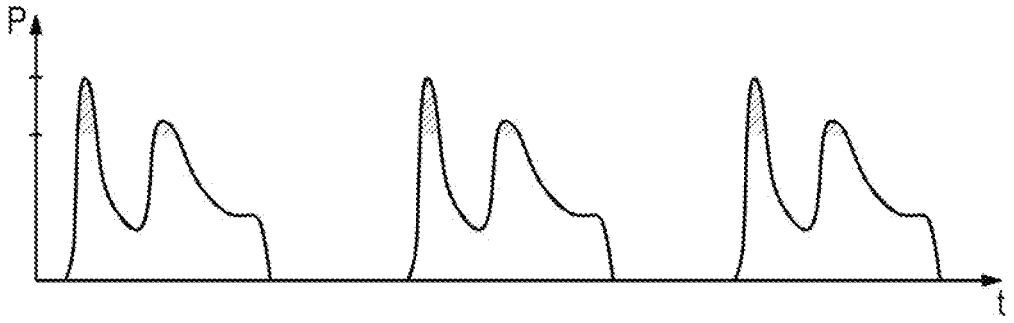
FIG. 6 shows a diagram illustrating the power draw of a cooking device during multiple cooking processes.

FIG. 6 illustrates a scenario in which several cooking processes are carried out in the course of a day, in the example embodiment three cooking processes.

For example, at least during the first cooking process, the cooking device 14 is operated exclusively by means of the energy storage device 12, provided that the energy storage device 12 has been charged by means of renewable energies. In this way, the use of fossil fuels or nuclear energy to operate the cooking device 14 can be reduced. Only when the energy storage device 12 has been discharged to a defined state of charge or has been completely discharged, the cooking device 14 is again operated with electricity from the electrical grid 18, for example during the third cooking process. Preferably, the energy storage device 12 is not completely discharged during the first cooking processes, so that the energy storage device 12 can still be switched on during the third cooking process to cover peak demand.

Subsequently, the energy storage device 12 can be recharged, for example by means of electricity generated from renewable energies and/or by means of night current.

In particular, the control unit 22 is set up to control a charging process for charging the energy storage device 12. For example, the control unit 22 controls the charging process of the energy storage device 12 such that the charging process starts when an expected heating requirement is low over the duration of the charging process. A power demand for the period in which the charging process takes place can thus preferably be covered entirely from the electrical grid 18.

The system 10 further includes a kitchen management means 26 which controls the course of various cooking processes.

The control units 22 are connected to the kitchen management means 26 such that the control units 22 can receive information from the kitchen management means 26 about current and/or planned cooking processes, in particular information about a heating requirement of the cooking processes.

For this purpose, the control units 22 are communicatively connected to the kitchen management means 26 either wirelessly or via electrical lines.

Based on the information received from the kitchen management means 26 about a heating requirement of the cooking processes, the control units 22 can regulate a power draw from the electrical grid 18 and/or from the energy storage devices 12.

For example, the control unit 22 is set up to charge the energy storage device 12 by means of renewable energies, in particular by means of photovoltaics or wind energy, and/or by means of night current.

The invention claimed is:

1. A system comprising at least one cooking device having a cooking chamber, the cooking device having a connection for connecting the cooking device to an electrical grid and a connection for connecting the cooking device to an energy storage device, and comprising a control unit which is set up to regulate a power draw from the electrical grid and/or from the energy storage device during operation of the at least one cooking device based on a heating requirement of the cooking device such that the power draw from the electrical grid does not exceed a defined threshold value ($L_{Max}$), wherein the control unit is configured to regulate the power draw from the energy storage device based on an expected heating requirement such that the control unit is configured to delay a power draw from the energy storage device if it is foreseeable that the energy from the energy storage device will be needed at a later time.

2. The system according to claim 1, wherein the control unit is configured to regulate the power draw from the electrical grid and/or from the energy storage device based on a current heating requirement.

3. The system according to claim 1, wherein the control unit is configured to operate the cooking device such that a power draw takes place simultaneously from the electrical grid and the energy storage device to cover demand peaks during a cooking process.

4. The system according to claim 1, wherein the control unit is configured to operate the cooking device such that during a preheating phase, a power draw takes place simultaneously from the electrical grid and the energy storage device.

5. The system according to claim 1, wherein the control unit is configured to regulate a power draw from the energy storage device such that the power draw from the energy storage device takes place over a period of no more than 15 minutes at a time.

6. The system according to claim 1, wherein the system includes a kitchen management computer readable program code which includes computer readable program steps configured to control the course of various cooking processes, the control unit being connected to the kitchen management computer readable program code such that the control unit is configured to receive information from the kitchen management computer readable program code about current and/or planned cooking processes.

7. The system according to claim 1, wherein the control unit is configured to operate the cooking device such that, in the event of a failure of the electricity supply by the electrical grid, the cooking device is configured to be operated by the energy storage device alone.

8. The system according to claim 1, wherein the control unit is configured to control a charging process for charging the energy storage device.

9. The system according to claim 8, wherein the control unit is configured to charge the energy storage device using renewable energies.

10. The system according to claim 9, wherein the control unit is configured to operate the cooking device such that a power draw takes place exclusively from the energy storage device when the latter has been charged with renewable energies.

11. The system according to claim 10, wherein the system includes at least one energy storage device to which the cooking device is connected.

12. The system according to claim 11, wherein the energy storage device is arranged separately from the cooking device.

13. A system comprising at least one cooking device having a heated cooking chamber, the cooking device having a connection configured for connecting the cooking device to an electrical grid and a connection configured for connecting the cooking device to an energy storage device, and comprising a control unit which is configured to regulate a power draw from the electrical grid and/or from the energy storage device during operation of the at least one cooking device based on a heating requirement of the cooking device such that the power draw from the electrical grid does not exceed a defined threshold value ($L_{Max}$), wherein the control unit is configured to operate the cooking device such that during a preheating phase, a power draw takes place simultaneously from the electrical grid and the energy storage device.

* * * * *